US006540489B1

(12) United States Patent
Higashiyama

(10) Patent No.: US 6,540,489 B1
(45) Date of Patent: Apr. 1, 2003

(54) MOTOR DRIVEN COMPRESSOR

(75) Inventor: Akiyoshi Higashiyama, Gunma (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/661,791

(22) Filed: Sep. 14, 2000

(30) Foreign Application Priority Data

Sep. 14, 1999 (JP) ..... 11-259832

(51) Int. Cl.[7] ..... F04B 17/00
(52) U.S. Cl. ..... 417/410.1
(58) Field of Search ..... 417/410.1, 410.3, 417/410.5; 418/151, 55.1; 310/68 R

(56) References Cited

U.S. PATENT DOCUMENTS 4,347,453 A * 8/1982 Gaus ..... 310/104
4,439,118 A 3/1984 Iimori
4,475,875 A 10/1984 Sugimoto et al.
4,597,724 A 7/1986 Sato et al.
4,824,346 A 4/1989 Hiraga et al.
4,846,635 A * 7/1989 Fry et al. ..... 417/410.1
4,998,864 A * 3/1991 Muir ..... 417/319
5,967,763 A * 10/1999 Horng ..... 310/68 R
5,993,171 A * 11/1999 Higashiyama ..... 417/308
5,993,177 A * 11/1999 Terauchi et al. ..... 417/308
6,017,205 A * 1/2000 Weatherston et al. ..... 184/6
6,089,840 A * 7/2000 Iizuka et al. ..... 418/151
6,132,179 A * 10/2000 Higashiyama ..... 417/308
6,234,769 B1 * 5/2001 Sakai et al. ..... 417/374
6,261,071 B1 * 7/2001 Williams et al. ..... 417/366
6,315,528 B1 * 11/2001 Williams et al. ..... 340/649

FOREIGN PATENT DOCUMENTS

JP 9-045530 2/1997

* cited by examiner

*Primary Examiner*—Teresa Walberg
*Assistant Examiner*—Vinod D Patel
(74) *Attorney, Agent, or Firm*—Baker Botts L.L.P.

(57) ABSTRACT

A motor driven compressor has a motor and a compressing mechanism connected to the motor through a rotary shaft, which is located within a housing, and an offset of phase is set between a stator and a rotor. The rotor is mounted to the rotary shaft, allowing the rotor to rotate so that it may be magnetized. Further, the motor driven compressor has a driving member driven together with the rotary shaft, a communication gas hole formed within the housing and extending from a suction port to a discharge hole, and a mark positioned along a radial axis on a first end surface of the driving member. The mark is used for setting the offset of phase between the stator and the rotor on the basis of a mark, by positioning the mark opposite the suction port. Accordingly, the motor driven compressor has a structure, which allows the rotor to be readily magnetized and may reliably set the offset of phase between the rotor and stator for magnetizing the rotor.

23 Claims, 6 Drawing Sheets

MOTOR DRIVEN COMPRESSOR

BACKGROUND OF THE INVENTION

1. Field of the Invention

The present invention relates to motor driven compressors incorporated in air conditioning systems.

2. Description of Related Art

Known motor driven compressors include a compressing mechanism and a motor, which includes a rotary shaft, which are located within a housing. The rotary shaft drives the compressing mechanism within the housing. In such motor driven compressors, a stator and a rotor, comprising the motor, may be positioned within the housing. An offset of phase between the stator and the rotor is set, and the rotor then is magnetized.

FIG. #8 depicts a partial cross-sectional view of a known motor driven compressor, as described in Japanese Patent Application Publication No. 09-45530.

Referring to FIG. #8, the motor driven compressor includes a;,direct current motor 102 and compressing mechanism (not shown), which is connected to direct current motor 102 via a rotary shaft 103 within a housing 101. Direct current motor 102 includes stator 104 and rotor 105. Stator 104 is fixed within housing 101, and rotor 105 is mounted on rotary shaft 103. Rotary shaft 103 is rotatably supported by bearing 120. Suction port 109 is formed within housing 101. A mark 108, such as crossing groove, is formed on a first end surface of rotary shaft 103. Housing 101 has a hole 106, which is positioned opposite a second end of rotary shaft 103. Hole 106 is closed by a sealing bolt 107.

In such known motor driven compressors, after direct current motor 102, rotary shaft 103, and compressing mechanism (not shown) are positioned within housing 101, the offset of phase between stator 104 and rotor 105 is set using a jig (not shown), such as a positioning member. Specifically, from outside housing 101, the jig (not shown) engages with mark 108 through hole 106. Subsequently, the jig is rotated around its axis to rotate rotary shaft 103 and rotor 105. Thereby, the phase offset between stator 104 and rotor 105 is set. Once in position, rotor 102 is magnetized. Finally, after magnetization, hole 106 is closed by sealing bolt 107. Magnetization occurs when current is provided to stator 104 via an electrical wire (not shown), which causes a magnetic force generated in stator 104 to act upon rotor 105.

In the known motor driven compressor described above, after magnetization, hole 106 of housing 101 is closed by sealing bolt 107. This configuration complicates such compressor's structure by increasing the number of parts.

FIG. #9 depicts a partial cross-sectional view of another known motor driven compressor, as also described in Japanese Patent Application Publication No. 09-45530.

A mark 118 is formed on a first end surface of rotor 105 of direct current motor 102. Suction port 109 is formed within housing 101. Suction port 109 is positioned opposite mark 118. In this known motor driven compressor, after direct current motor 102 and compressing mechanism are installed and enclosed within housing 101, a jig (not shown) is inserted inside housing 101 through suction port 109. Subsequently, rotor 105 is rotated to offset the phase between stator 105 and rotor 104, so as to position mark 118 of rotor 105 opposite suction port 109. Finally, once mark 118 is in position, rotor 105 is magnetized.

In the known motor driven compressor described above, rotor 105 is machined with a mark, such as a hole. Therefore, this compressor has increased manufacturing costs and during machining, it is difficult to maintain the angle between rotor 105 and rotary shaft 103.

SUMMARY OF THE INVENTION

It is an object of the present invention to provide a motor driven compressor of structure, which allows the rotor to be readily magnetized, and which may reliably set the offset of phase between the rotor and stator for magnetizing the rotor.

It is an another object of the present invention to decrease the number of parts and to provide a motor driven compressor, in which the rotor need not be machined with a mark.

According to an embodiment of the present invention, a motor driven compressor has a motor and a compressing mechanism connected to the motor through a rotary shaft, which are located within a housing, and an offset of phase is set between a stator and a rotor. The rotor is mounted on the rotary shaft, which allows the rotor to rotate, so that it may be magnetized. Further, according to this embodiment, the housing of the motor driven compressor has a communication gas hole, which extends from a suction port to a discharge hole. Additionally, according to this embodiment, the motor driven compressor has a driving member driven together with the rotary shaft, and a mark positioned along a radial axis on a first end surface of the driving member. The mark is used for setting the offset of phase between the stator and the rotor on the basis of the mark, by positioning the mark opposite the suction port.

According to another embodiment of the present invention, a rotor in a motor driven compressor is magnetized by connecting a compressing mechanism to the motor through a rotary shaft, which are located within a housing, and setting the offset of phase between a stator of the motor and the rotor, where the rotor is mounted to a rotary shaft, allowing the rotor to rotate, so that it may be magnetized. Additionally, according to this embodiment, a driving member is driven together with the rotary shaft, and a mark is positioned along a radial axis on a first end surface of the driving for setting the offset of phase between the stator and the rotor on the basis of the mark, by positioning the mark opposite the suction port.

Other objects, features, and advantages will be apparent to persons of ordinary skill in the art in view of the following detailed description of the invention and the accompanying drawings.

DETAILED DESCRIPTION OF PREFERRED EMBODIMENTS

Figure 1:
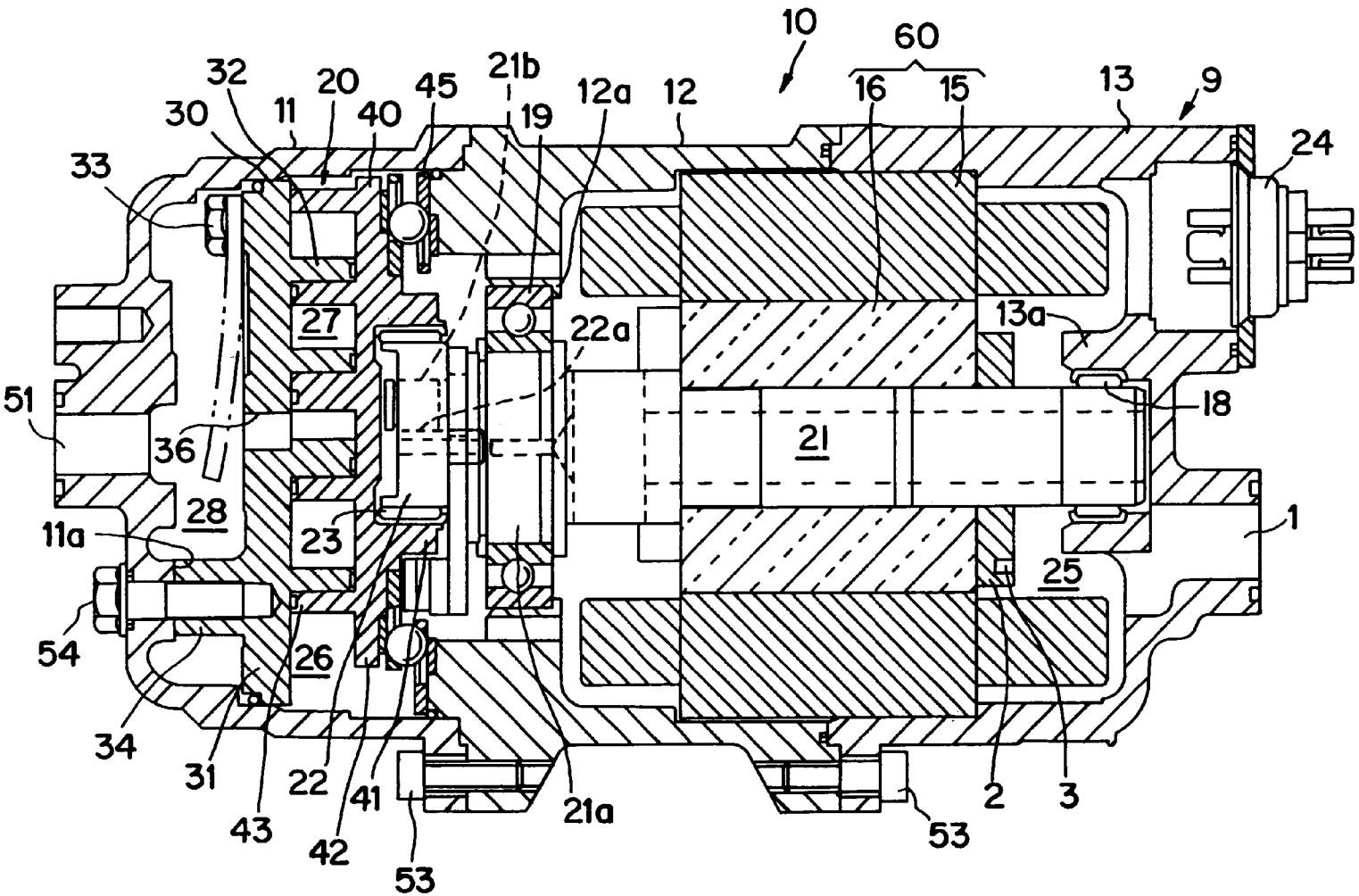
FIG. 1 is a cross-sectional view of the motor driven compressor in accordance with a first embodiment of a present invention.
Figure 2A:
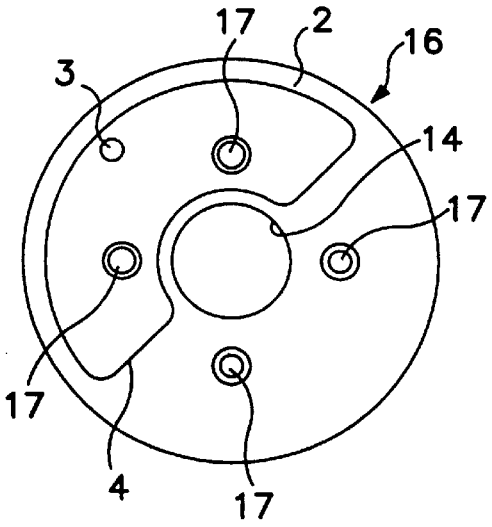
FIG. 2(*a*) is a plane view of the rotor of FIG. 1, FIG. 2(*b*) is a vertical-sectional view of FIG. 2(*a*).
Figure 2B:
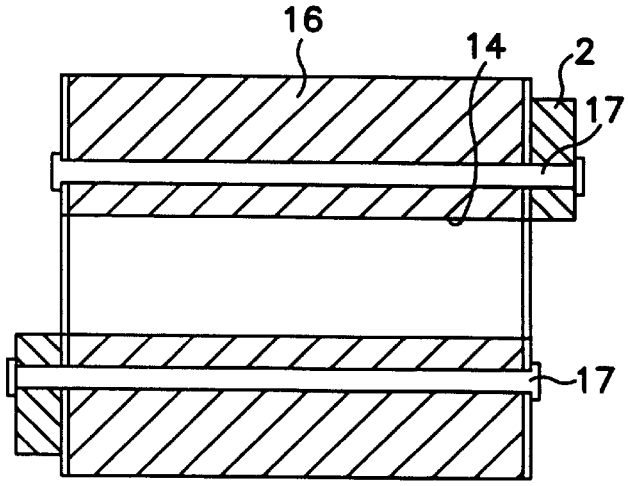
Figure 3:
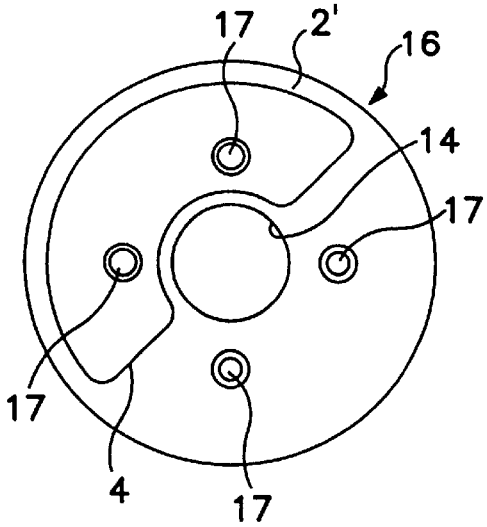
FIG. 3 is a plane view of the rotor of the motor driven compressor in accordance with a second embodiment of a present invention.

FIG. #1 shows a cross-sectional view of a motor driven compressor in accordance with a first embodiment of the present invention.

With reference to FIG. #1, motor driven compressor 10 includes scroll compressing mechanism 20, rotary shaft 21, and motor 60. The scroll compressing mechanism 20, rotary shaft 21, and motor 60 are accommodated within casing 9. Casing 9 is comprised of first housing portion 11, second housing portion 12, and third housing portion 13. Housing portions 11, 12, and 13 are connected to each other via bolts 53.

Scroll compressing mechanism 20 is disposed within first housing portion 11. Scroll compressing mechanism 20 includes fixed scroll member 30, which is fixed within first housing portion 11, and orbiting scroll member 40, which is engaged with fixed scroll member 30. Orbiting scroll member 40 includes bottom plate 42; spiral element 43, which is formed on a first end surface of bottom plate 42; and boss member 41, which is formed on a second end surface of bottom plate 42. Orbiting scroll member 40 is supported on a first end of second housing portion 12 by a rotation preventing mechanism 45. Rotation preventing mechanism 45 is comprised of a ball-coupling, which is disposed around boss member 41. Fixed scroll member 30 includes bottom plate 31; spiral element 32, which is formed on a first end surface of bottom plate 31; discharge valve mechanism 33, which is formed on a second end surface of bottom plate 31; and fixed member 34. Fixed scroll member 30 is fixed to bottom wall portion 11*a* of first housing portion 11 by bolts 54 via fixed member 34. Moreover, discharge valve mechanism 33 may discharge fluid from motor driven compressor 10.

Motor 60 is accommodated within space 25 of second housing portion 12 and third housing portion 13. Motor 60 is comprised of stator 15 and rotor 16. Stator 15 is fixed within housing portions 12 and 13. Rotor 16 is mounted to rotary shaft 21.

A first end of rotary shaft 21 is rotatably supported by bearing 18, which is disposed within boss member 13*a* of third housing portion 13. A second end of rotary shaft 21 includes large diameter portion 21*a*. Large diameter potion 21*a* is rotatably supported by bearing 19, which is disposed within small diameter portion 12*a* of second housing portion 12. A first end of large diameter potion 21*a* includes pin member 21*b*, which projects from the end surface of large diameter potion 21*a*. The axis of pin member 21*b* is radially offset from the axis of rotary shaft 21. Pin member 21*b* is rotatably disposed within hole 22*a* of bushing 22. The axis of hole 22*a* of bushing 22 is radially offset from the axis of bushing 22. Bushing 22 is rotatably disposed within boss 41 of orbiting scroll member 40 through bearing 23.

A first end of third housing portion 13 includes suction port 1 and connector 24 for connecting a coil of rotor 16 to an external power source.

A first end surface of rotor 16 includes counterbalance weight 2, which reduces or eliminates the unbalancing effect on orbiting scroll member 40.

In the above described motor driven compressor 10, when motor 60 rotates rotary shaft 21, orbiting scroll member 40 orbits fixed scroll member 30, without rotating. Thus, refrigerant gas, which is introduced from a component, such as an evaporator (not shown) of a refrigerant circuit (not shown), through suction port 1, travels through spaces 25 and 26 into the fluid pockets 27, which are formed from the outer end portion of the spiral elements 32 and 43. The refrigerant which traveled into the fluid pockets 27 then is compressed and discharged through discharge port 36, discharge chamber 28 and discharge hole 51, from which it then travels to another component, such as a condenser (not shown) of the refrigerant circuit (not shown). This passage, extending from the suction port 1 to the discharge hole 51, through which the refrigerant gas travels, defines a communication gas chamber.

With reference to FIG. #2, counterbalance weight 2 is fixed on a first end surface of rotor 16 by fixed member 17, such as by pins or bolts. Moreover, rotary shaft 21 is inserted through and fixed by hole 14. Counterbalance weight 2 is half-ring shaped. Mark 3 is formed on a first end surface of counterbalance weight 2, such as a hole. Mark 3 is located at a central position along a radial axis on counterbalance weight 2. With reference to FIG. #1, mark 3 opposes suction port 1.

To set the offset of phase between stator 15 and rotor 16 prior to magnetizing rotor 16, from the outside of compressor 10, a jig, such as positioning pin (not shown), is inserted inside housing portion 13 through suction port 1. Subsequently, the offset of phase between stator 105 and rotor 104 is set on the basis of mark 3, so as to oppose mark 3 to suction port 1 using the jig. Finally, once mark 3 is in position, current is provided to stator 16 via an electrical wire (not shown), which causes a magnetic force from stator 15 to act upon on rotor 16.

FIG. #3 shows a plane view of the rotor 16 of the motor driven compressor in accordance with a second embodiment of a present invention. The compressor has substantially the same structure as the motor driven compressor according to the first embodiment of the present invention. Therefore, the following description focuses on the differences between the first and second embodiments.

With reference to FIG. #3, a half-ring shaped counterbalance weight 2 includes a first side of rotor 16. Counterbalance weight 2' has substantially the same profile as counter balance weight 2 of the motor driven compressor, as described in FIG. #2, except it does not include mark 3. Instead, counterbalance weight 2' of FIG. #3 uses the cross sectional portion 4 in place of mark 3 of FIG. #2, to position rotor 16. Specifically, the offset of the phase between stator 15 and rotor 16 is set on the basis of cross-sectional portion 4 for magnetization of rotor 16 using a jig (not shown), such as positioning a pin through suction port 1.

FIG. #4 shows a partial, cross-sectional view of the motor driven compressor in accordance with a third embodiment of a present invention. FIG. #5 is a plane view of the counterbalance weight 5 of FIG. #4. The compressor FIGS. #4 and #5 differs from the compressor according to the first and second embodiments of the present invention. The following discussion will focus on these differences.

Figure 4:
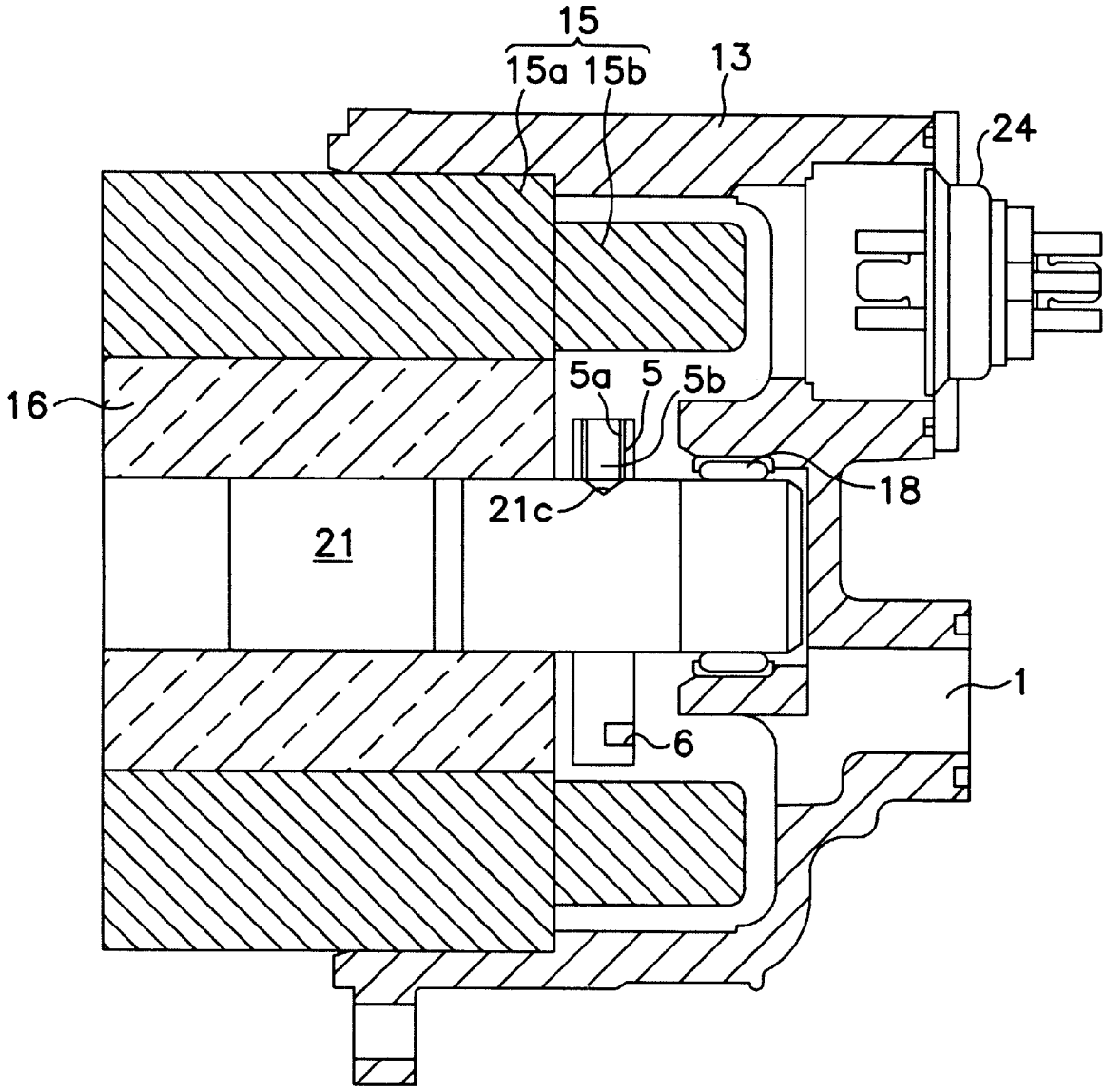
FIG. 4 is a partial, cross-sectional view of the motor driven compressor in accordance with a third embodiment of a present invention.

With reference to FIG. #4 and FIG. #5, counterbalance weight 5 is fixed to rotary shaft 21 by fixed member 5*b*, such as by a screw. Counterbalance weight 5 is ring-shaped, and a lower area of counterbalance weight 5 is formed with an area greater than that of the upper area of counterbalance weight 5. Counterbalance weight 5 has a screw hole 5*a* formed along a radial direction on counterbalance weight 5. Further, rotary shaft 21 is formed in key groove 21*c*. Mark 6, such as a hole, is formed on a first end surface of counterbalance weight 5. Mark 6 is located at a central position along a radial axis on counterbalance weight 5. With reference to FIG.4, mark 3 opposes suction port 1.

The compressor has substantially the same structure as the motor driven compressor according to the first embodiment of the present invention, except that counterbalance weight 5 is fixed to rotary shaft 21 instead of a first end portion of rotor 16. Therefore, the following discussion will focus only on these differences between the first and third embodiments. Specifically, the offset of phase between stator 15 and rotor 16 is set on the basis of mark 6 for magnetizing rotor 16 using a jig, such as positioning pin (not shown), through suction port 1.

FIG. #6 shows a plane view of the counterbalance weight 5' of a motor driven compressor in accordance with a fourth embodiment of the present invention.

Figure 5:
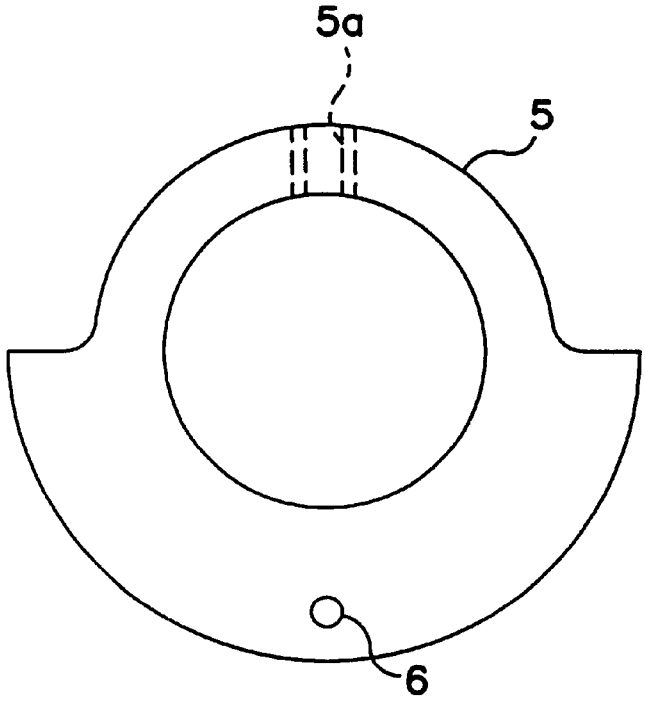
FIG. 5 is a plane view of the counterbalance weight of FIG. 4.
Figure 6:
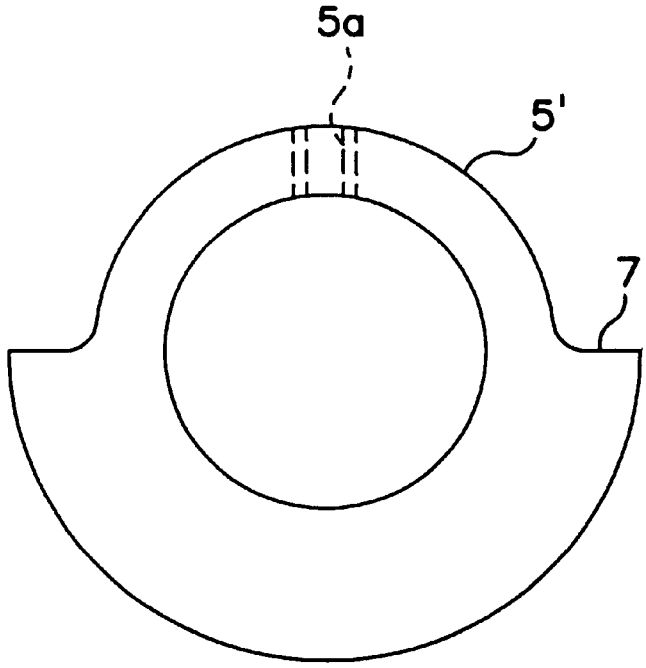
FIG. 6 is a plane view of the counterbalance weight of the motor driven compressor in accordance with a fourth embodiment of a present invention.

Counterbalance weight 5' has substantially the same profile as counterbalance weight 5 of FIG. 5, except it does not include mark 6. Instead, counterbalance weight 5' of FIG. #6 uses the cross-sectional portion 7 in place of mark 6 to position rotor 16. In other words, the offset of phase between stator 15 and rotor 16 is set on the basis of cross-sectional portion 7 for magnetizing rotor 16, using a jig (not shown), such as a positioning pin through suction port 1.

The motor driven compressor described above according to the first, second, third, and fourth embodiments of the present invention, may set the offset of phase between stator 15 and rotor 16 by using counterbalance weights 2, 2', 5, and 5' to maintain rotary balance. Consequently, in these embodiments, rotor 16 need not be machined with a mark, such as a hole, and the locating hole need not be closed, such as by using a sealing bolt. Thus, these embodiments may achieve a motor driven compressor of reduced cost.

Figure 7:
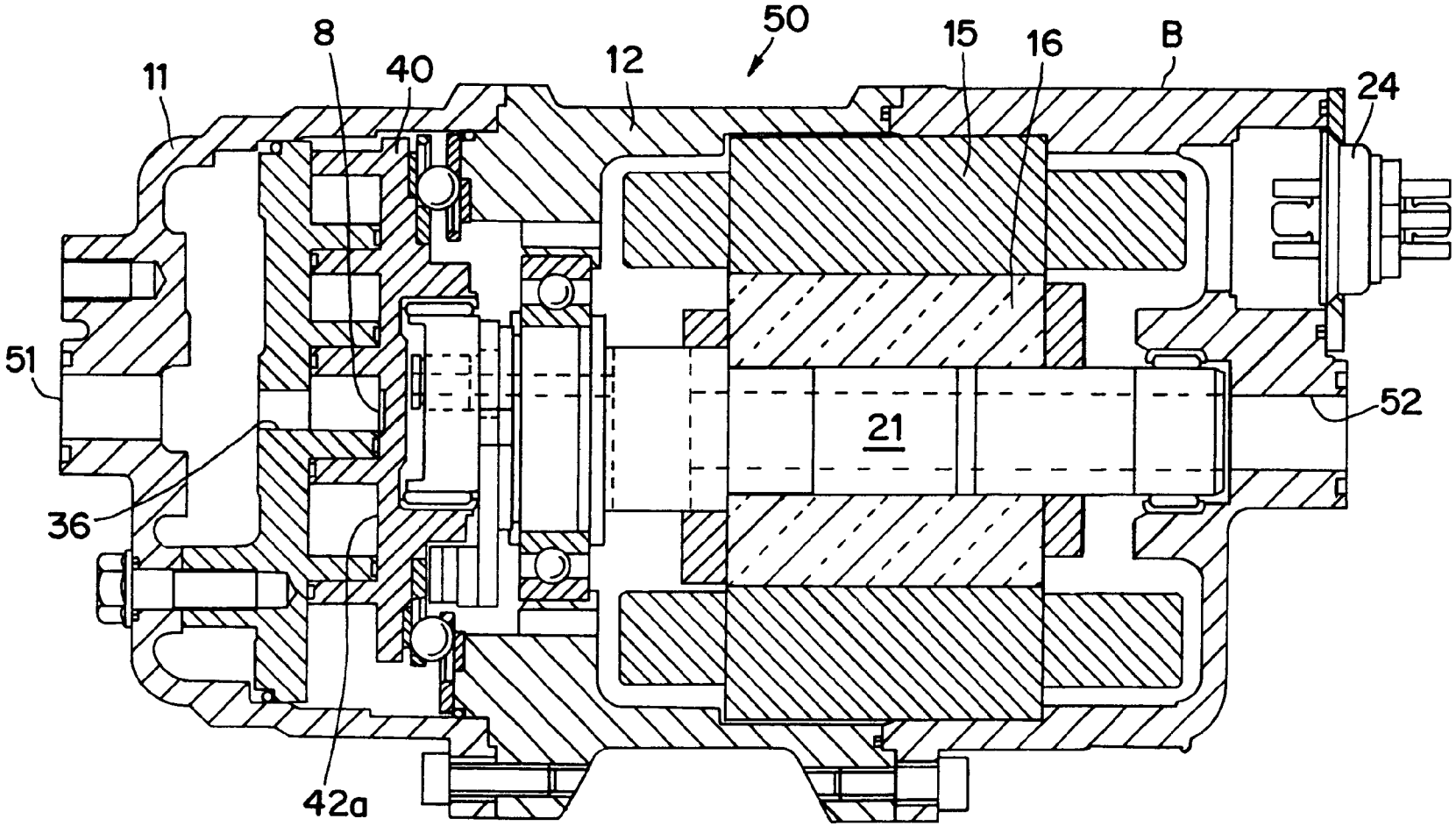
FIG. 7 is a cross-sectional view of the motor driven compressor in accordance with a fifth embodiment of a present invention.
Figure 8:
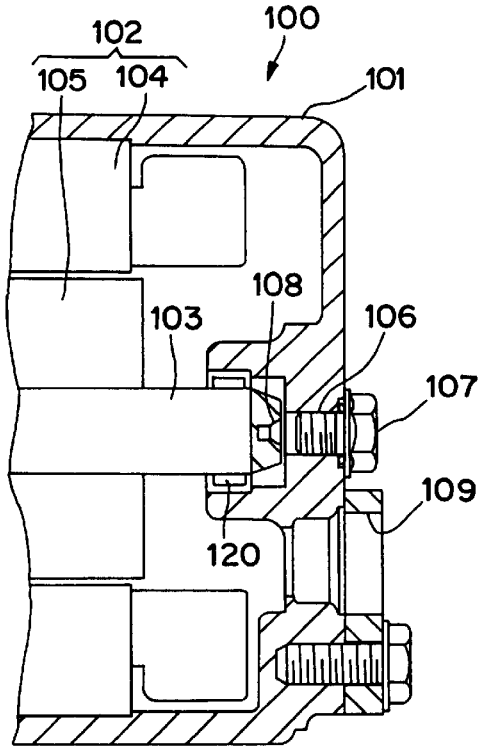
FIG. 8 PRIOR ART
FIG. 8 is a partial, cross-sectional view of a known motor driven compressor.
Figure 9:
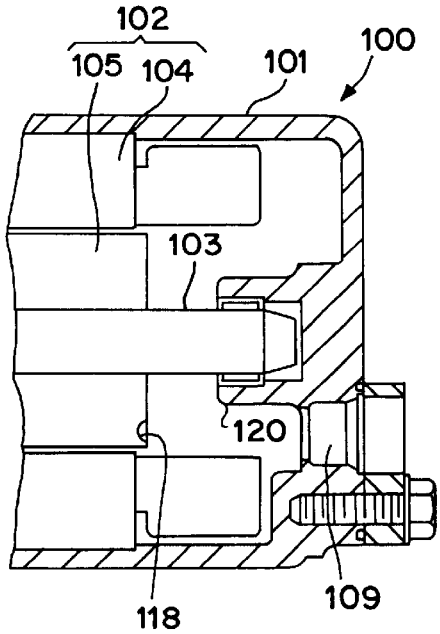
FIG. 9 PRIOR ART
FIG. 9 is a partial, cross-sectional view of another known motor driven compressor.

FIG.7 shows a cross-sectional view of the motor driven compressor in accordance with fifth embodiment of the present invention. The compressor has substantially the same structure as the motor driven compressor according to the above described embodiments, except suction hole 52 of third housing portion 13 is located substantially on the axis of the rotary shaft 21, and orbiting scroll member 40 has a mark 8, such as concave groove. Mark 8 is formed on a central end portion of 42*a* of bottom plate 42 of orbiting scroll member 40. Discharge hole 51 is located about on the axis of the discharge port 36. Mark 8 is located at a position corresponding to discharge hole 51 and discharge port 36.

The offset of phase between stator 15 and rotor 16 is set on the basis of mark 8 of orbiting scroll member 40 for magnetizing rotor 16, using a jig, such as a positioning pin (not shown), through discharge hole 51 and discharge port 36.

The motor driven compressor 50, in accordance with the fifth embodiment of the present invention, may set the position of rotor 16 with stator 15 based on an orientation between discharge hole 51, discharge port 36, and mark 8 of orbiting scroll member 40. Consequently, in this embodiment, rotor 16 need not be machined with a mark, such as a hole, and the locating hole need not be closed, such as by using a sealing bolt (FIG. #8). Thus, this embodiment also may produce a motor driven compressor of reduced cost.

This invention has been described in connection with preferred embodiments. These embodiments, however, are merely exemplary, and the invention is not intended to be restricted thereto. It will be understood by those of skill in the art that variations may be readily made within the scope of this invention, as defined by the appended claims.

What is claimed is:

1. A motor driven compressor, having a motor and a compressing mechanism connected to said motor through a rotary shaft, which are located within a housing, wherein an offset of phase is set between a stator of said motor and a rotor of said motor and wherein said rotor is mounted to said rotary shaft, which allows said rotor to rotate so, that it may be magnetized, comprising:

a driving member driven together with said rotary shaft, a communication gas passage formed within said housing and extending from a suction port to a discharge hole, and a mark positioned along a radial axis on a first end surface of said driving member for setting said offset of phase between said stator and said rotor on the basis of said mark, by positioning said mark opposite said suction port.

2. The motor driven compressor of claim 1, wherein said driving member is a counterbalance weight positioned on a first end surface of said rotor.

3. The motor driven compressor of claim 2, wherein said counterbalance weight has said mark, which is a hole formed through said counterbalance weight, wherein said hole is formed on said first end surface of said counterbalance weight positioned opposite said suction port.

4. The motor driven compressor of claim 2, wherein said counterbalance weight is fixed on said first end surface of said rotor by a fixed member.

5. The motor driven compressor of claim 2, wherein said counterbalance weight is fixed on said rotary shaft by a fixed member.

6. The motor driven compressor of claim 2, wherein said counterbalance weight is half-ring shaped.

7. The motor driven compressor of claim 2, wherein said mark is located at a middle position along said radial axis on said counterbalance weight.

8. The motor driven compressor of claim 2, wherein said mark is located at an end position along said radial axis on said counterbalance weight.

9. The motor driven compressor of claim 1, wherein said mark is a hole formed through said first end surface of said driving member positioned opposite said suction port.

10. The motor driven compressor of claim 9, wherein said driving member is a counterbalance weight positioned on a first end surface of said rotor.

11. The motor driven compressor of claim 10, wherein said driving member is a counterbalance weight and said mark is formed on said first end surface of said counterbalance weight positioned opposite said suction port.

12. The motor driven compressor of claim 10, wherein said counterbalance weight is fixed on said first end surface of said rotor by a fixed member.

13. The motor driven compressor of claim 10, wherein said counterbalance weight is fixed on said rotary shaft by a fixed member.

14. The motor driven compressor of claim 10, wherein said counterbalance weight is half-ring shaped.

15. The motor driven compressor of claim 10, wherein said mark is located at a middle position along said radial axis on said counterbalance weight.

16. The motor driven compressor of claim 10, wherein said mark is located at an end position along said radial axis on said counterbalance weight.

17. A motor driven compressor, having a motor and a compressing mechanism connected to said motor through a rotary shaft, which are located within a housing, wherein an offset of phase is set between a stator of said motor and a rotor of said motor and wherein said rotor is mounted to said rotary shaft, which allows said rotor to rotate so, that it may be magnetized, comprising:

a driving member driven together with said rotary shaft, a communication gas passage formed within said housing and extending from a suction port, to a discharge hole, and a mark formed on a central end portion of said driving member for setting the offset of phase between said rotor and said stator based on an orientation between said mark and said discharge hole.

18. The motor driven compressor of claim 17, wherein said driving member is an orbiting scroll member, and said mark is formed on a central end portion of a bottom plate of said orbiting scroll member.

19. The motor driven compressor of claim 18, wherein said mark is a concave groove.

20. A motor driven compressor, having a motor and a compressing mechanism connected to said motor through a rotary shaft, which is located within a housing, and a set offset of phase between a stator of said motor and a rotor of said motor, wherein said rotor is mounted to said rotary shaft, which allows said rotor to rotate, so that it may be magnetized, comprising:

a counterbalance weight driven together with said rotary shaft, and a communication gas passage formed within said housing and extending from a suction port to a discharge hole, wherein said counterbalance weight has a mark formed through said counterbalance weight located at a middle position along said radial axis on said counterbalance weight, for setting said offset of phase between said stator and said rotor on the basis of said mark, by positioning said mark opposite said suction port.

21. A motor driven compressor, having a motor and a compressing mechanism connected to said motor through a rotary shaft, which is located within a housing, and a set offset of phase between a stator of said motor and a rotor of said motor, wherein said rotor is mounted to said rotary shaft, which allows said rotor to rotate, so that it may be magnetized, comprising:

a counterbalance weight driven together with said rotary shaft, and fixed on a first end surface of said rotor by a fixed member, and a communication gas port formed within said housing and extending from a suction port to a discharge hole, wherein said counterbalance weight has a mark formed through said counterbalance weight, wherein said mark is positioned along a radial axis on a first end surface of said driving member for setting said offset of phase between said stator and said rotor on the basis of said mark, by positioning said mark opposite said suction port.

22. A motor driven compressor, having a motor and a compressing mechanism connected to said motor through a rotary shaft, which is located within a housing, and a set offset of phase between a stator of said motor and a rotor of said motor, wherein said rotor is mounted to said rotary shaft, which allows said rotor to rotate so, that it may be magnetized, comprising:

a driving member which rotates together with said rotary shaft, and a communication gas hole formed within said housing and extending from a suction port to a discharge hole, wherein a mark is positioned along a radial axis on a first end surface of said driving member for setting said offset of phase between said stator and said rotor on the basis of said mark, by positioning said mark opposite said suction port.

23. A method of magnetizing a rotor in a motor driven compressor comprising the steps of:

connecting a compressing mechanism to a motor through a rotary shaft, which are located within a housing, setting an offset of phase between a stator of said motor and a rotor of said motor, wherein said rotor is mounted to said rotary shaft, which allows said rotor to rotate, so that it may be magnetized, driving a driving member together with said rotary shaft, and positioning a mark along a radial axis on a first end surface of said driving member for setting said offset of phase between said stator and said rotor on the basis of said mark, by positioning said mark opposite a suction port.

* * * * *